US006178941B1

(12) United States Patent
Martinsson

(10) Patent No.: US 6,178,941 B1
(45) Date of Patent: Jan. 30, 2001

(54) DEVICE IN A POWER-DRIVEN TOOL

(75) Inventor: Pär Martinsson, Jönköping (SE)

(73) Assignee: Aktiebolaget Electrolux, Stockholm (SE)

( * ) Notice: Under 35 U.S.C. 154(b), the term of this patent shall be extended for 0 days.

(21) Appl. No.: 08/974,088

(22) Filed: Nov. 19, 1997

(30) Foreign Application Priority Data

Dec. 18, 1996 (SE) ..... 9604656

(51) Int. Cl.[7] ..... B27B 17/00
(52) U.S. Cl. ..... 123/198 D; 123/400
(58) Field of Search ..... 123/198 D, 398, 123/400

(56) References Cited

U.S. PATENT DOCUMENTS 4,302,880 * 12/1981 Elfving et al. ..... 123/398
4,386,746 * 6/1983 Okamura ..... 206/389
4,495,911 * 1/1985 Andreasson ..... 123/198 D
4,524,741 * 6/1985 Corbi ..... 123/398
4,570,593 * 2/1986 Take et al. ..... 123/398
4,798,185 * 1/1989 Driggers ..... 123/400
4,951,846 * 8/1990 Oster et al. ..... 222/146.5
5,517,967 * 5/1996 Nakayama ..... 123/398

* cited by examiner

*Primary Examiner*—Tony M. Argenbright
*Assistant Examiner*—Jason Benton
(74) *Attorney, Agent, or Firm*—Pearne & Gordon LLP

(57) ABSTRACT

A device in a power-driven tool, such as a motor saw, includes a handle (10) having a gas control (14) and a gas control catch (15). The gas control and the gas control catch have pivots (14*a*, 15*a*) adapted to be rotatably attached to the handle. In order to facilitate the assembly, the handle is provided with resilient bearing (11, 12) which allows the pivots to be mounted in the handle by a snap-in function.

8 Claims, 3 Drawing Sheets

DEVICE IN A POWER-DRIVEN TOOL

BACKGROUND OF THE INVENTION

The present invention relates to a device in a power-driven tool such as a motor saw, including a handle having a gas control rotatably attached thereto.

The gas control of a power-driven tool is used to control the speed of revolution of the engine, and in order to prevent unintentional actuation of the gas control a gas control catch is provided which catches the gas control in an unactuated position. Thus, before the gas control can be actuated, the catch must be released. The gas control and the gas control catch are provided with pivots journalled in complementary bearing cups in the handle. During assembly, the gas control and the gas control catch are mounted in their respective positions in the handle and a guide pin, usually made of steel, is subsequently inserted through a complementary bore in the gas control and the gas control catch, respectively. This bore must thus be accurately aligned with the bearing cup which means that the assembly will be relatively complicated and time consuming.

SUMMARY OF THE INVENTION

It is an object of the invention to eliminate the above-mentioned drawback of the prior art and to enable rapid and simple assembly of the gas control and the gas control catch in a power-driven tool. This object has been achieved by a device according to the invention the gas control has at least one pivot and the handle has resilient bearing means allowing the gas control to be mounted against the action of a resilient force and, after mounting, holding the pivot rotatably in the handle.

BRIEF DESCRIPTION OF THE DRAWINGS

The invention will be described in more detail in the following with reference to the accompanying drawings, wherein.

DETAILED DESCRIPTION OF THE PREFERRED EMBODIMENTS

Figure 1:
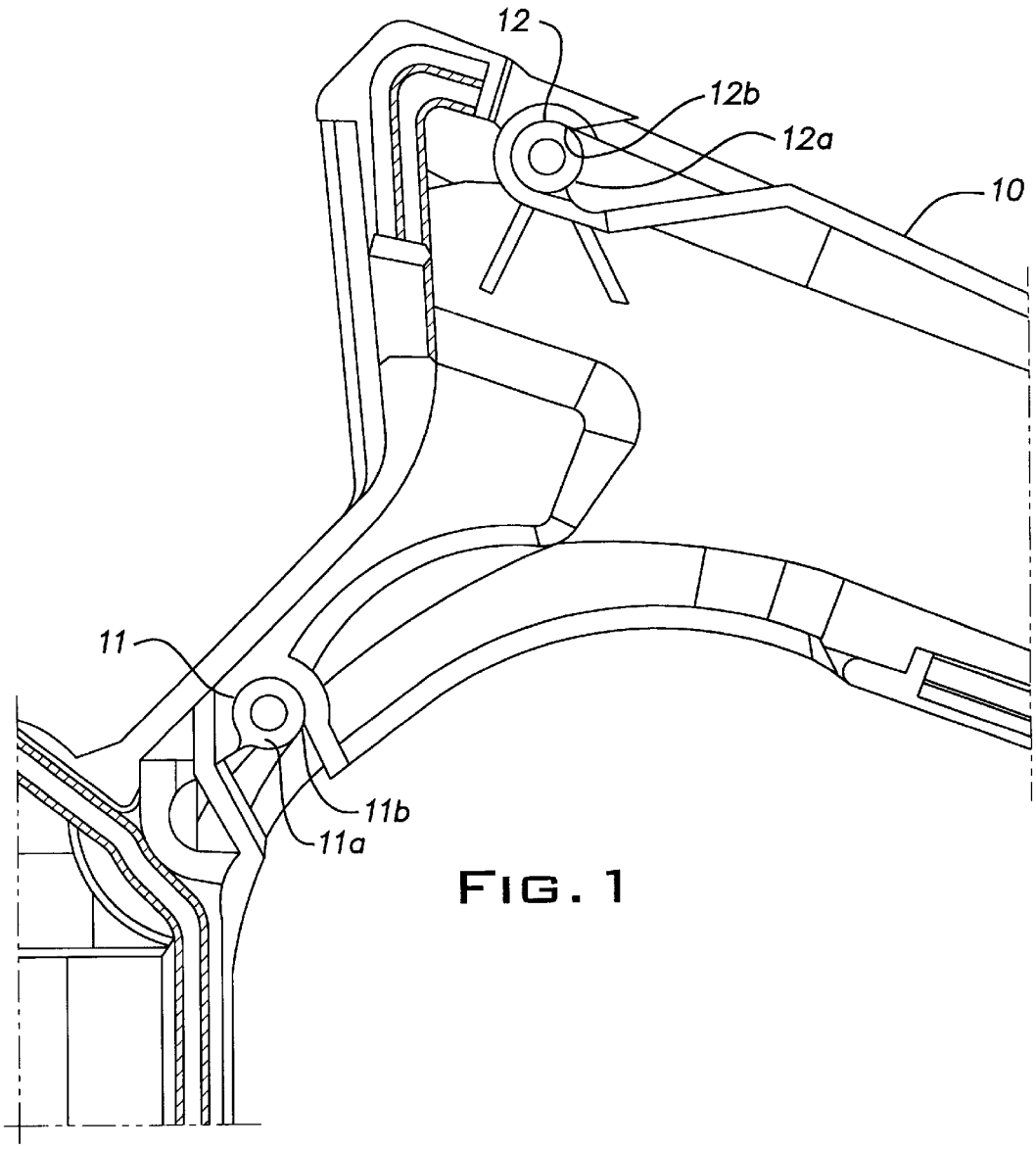
FIG. 1 is a partial longitudinal section on an enlarged scale of a handle of a power-driven tool, such as a motor chain saw, provided with a first embodiment of the device according to the invention.
Figure 2:
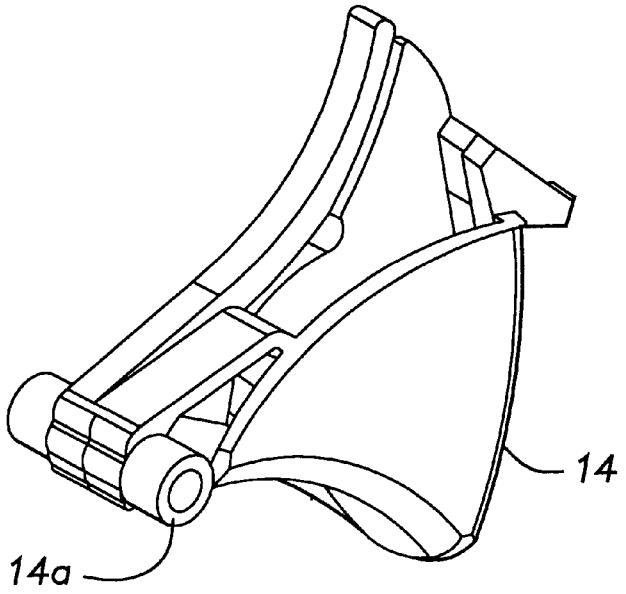
FIG. 2 is a perspective view of a gas control adapted to be mounted in the handle shown in FIG. 1.
Figure 3:
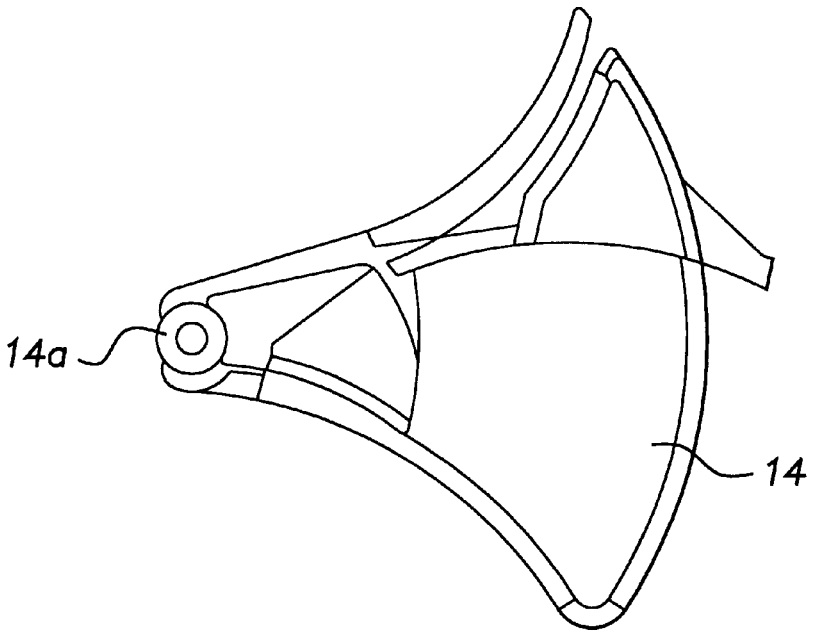
FIG. 3 is a side elevation of the gas control in FIG. 2.
Figure 4:
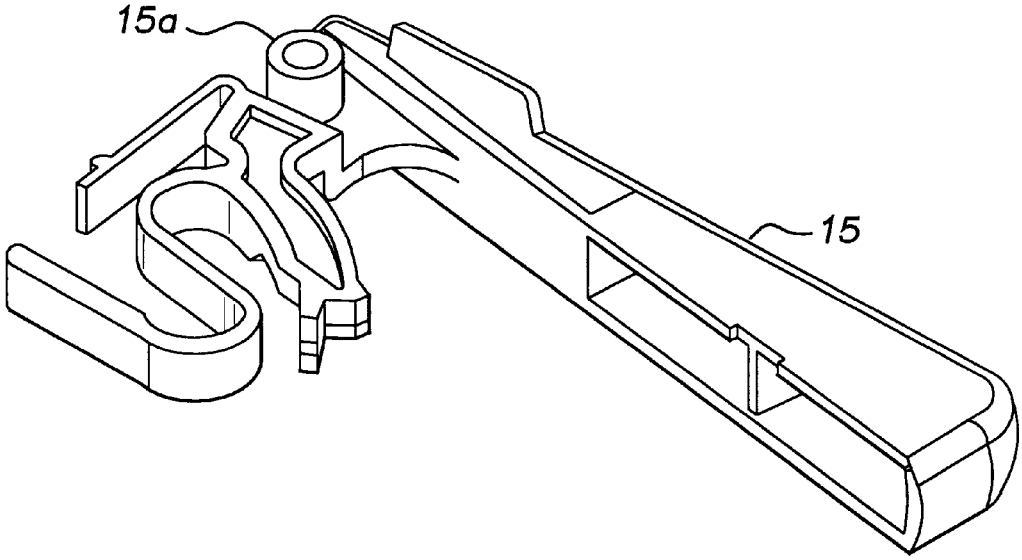
FIG. 4 is a perspective view of a gas control catch adapted to be mounted in the handle shown in FIG. 1.
Figure 5:
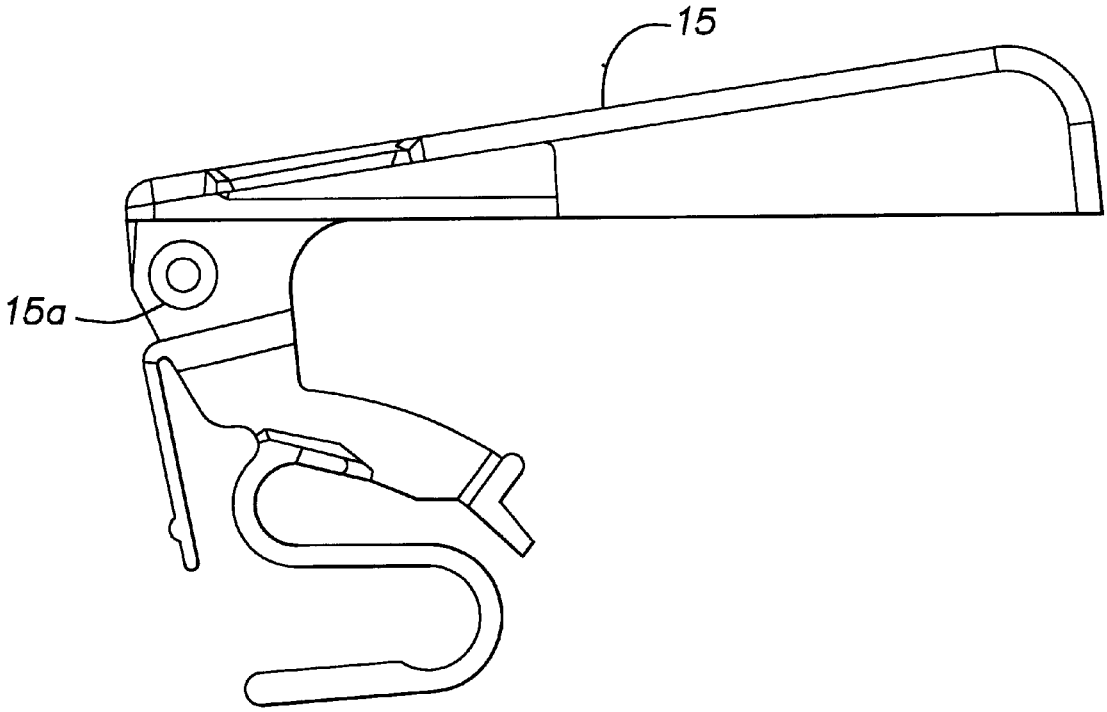
FIG. 5 is a side elevation of the gas control catch shown in FIG. 4.

The handle shown in FIG. 1 is generally designated 10 and has a first bearing cup 11 adapted to receive a gas control (FIGS. 2–3), and a second bearing cup 12 adapted to receive a gas control catch 15 (FIGS. 4–5). To this end, the gas control 14 has a pivot 14*a,* and the gas control catch has a pivot 15*a.* The pivots are preferably integrated with the respective means.

As shown in FIG. 1, the bearing cups 11, 12 have radial openings 11*a* and 12*a,* respectively, adapted to receive a pivot 14*a,* 15*a,* respectively. Both openings 11*a,* 12*a* have a pair of contrictions 11*b,* 11*c,* 12*b,* 12*c* respectively the distance between each constriction 11*b,* 11*c* and 12*b,* 12*c* within each pair being slightly less than the diameter of the corresponding pivot 14*a,* 15*a.*

When the gas control 14 and the gas control catch 15 are mounted in the handle 10, the respective pivot 14*a,* 15*a* is inserted through the opening 11*a,* 12*a* and is pushed through the pairs of constrictions 11*b,* 12*b,* respectively, such that the pivot snaps into the bearing cup 11, 12, respectively. The pivot is held in its correct position in the respective bearing cup by the pairs of constrictions 11*b,* 11*c* and 12*b,* 12*c* and no further attachment means are required. If preferred, the holding of the pivots 14*a,* 15*a* in the bearing cups can be ensured by inserting a guide pin (not shown) through an axial bore in the pivots and corresponding bores in the handle 10.

The positions of the openings 11*a,* 12*a* have been chosen with regard to the function of the respective control 14, 15 during operation of the chain saw, which means that the effective bearing surface of the bearing cups, as seen in the load direction, is not reduced.

Figure 6:
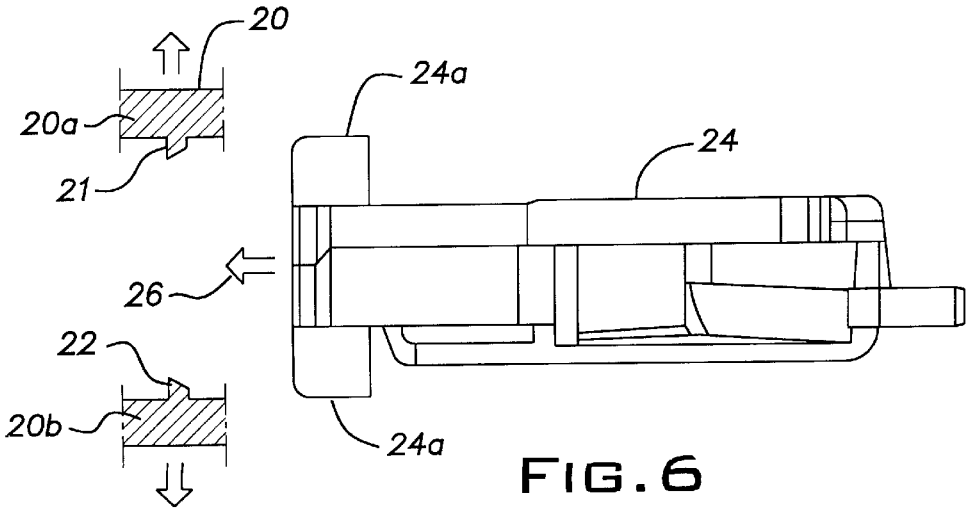
FIG. 6 is a top plan view of a gas control according to a second embodiment of the invention.

In the embodiment shown in FIG. 6, a handle 20, which is shown in section, has two opposite walls 20*a,* 20*b* provided with internal, integrated bearing pins 21, 22 facing each other. A gas control 24 is provided with pivots 24*a* having axial bores (not shown). As shown by an arrow 26, the pivots 24*a* are inserted between the walls 20*a,* 20*b* which are resilient and are pushed aside, until the bearing pins 21, 22 snap into the mentioned pivot bores and hold the pivots in a correct position. In order to facilitate the insertion the bearing pins 21, 22 as well as the pivots 24*a* are provided with appropriate bevels, as can be seen in the Figure. This embodiment of the invention is also applicable for rotatably mounting of a gas control catch according to FIGS. 4 and 5.

What is claimed is:

1. A device in a power-driven tool such as a motor saw, comprising a handle (10; 20) having a gas control (14; 24) rotatably attached thereto, wherein the gas control has a pivot (14*a*; 24*a*) and the handle has resilient bearing means (12; 21, 22), the bearing means having a constricted opening, allowing said gas control to be mounted to the handle by radially pushing said pivot through the constricted opening so that said bearing means resiliently deflects and said pivot snaps into engagement with said bearing means and, after mounting, holding said pivot rotatable in said handle.

2. Device according to claim 1, wherein the pivot (14*a*) is rotatably held in a complementary bearing cup (11) in the handle, said bearing cup having an opening (11*a*) for receiving said pivot and said opening being slightly smaller than a diameter of said pivot and being defined by a plurality of resilient constrictions (11*b,* 11*c*) allowing said pivot to be radially pushed through said opening and, after mounting, holding said pivot in said bearing cup.

3. Device according to claim 1, further comprising a gas control catch (15), said gas control catch being rotatably attached to the handle and including a second pivot (15*a*) journalled in a complementary second bearing cup (12) in the handle, said second bearing cup having a second constricted resilient opening (12*a*) for receiving said second pivot and said second opening being slightly smaller than a diameter of said second pivot allowing said second pivot to be radially pushed through said second opening and, after mounting, holding said second pivot in said second bearing cup.

4. Device according to claim 2, wherein said opening is facing from the load direction of the pivot (14*a*) during operation.

5. Device according to claim 1, wherein the handle (20) has two opposite bearing pins (21, 22) attached to resilient walls (20*a*, 20*b*) of the handle and adapted to engage in complementary axial bores in said pivot (24*a*).

6. Device according to claim 1, wherein said pivot (14*a*) has a through axial bore for receiving a locking pin.

7. Device according to claim 1, wherein said gas control has two cylindrically-shaped pivots which are coaxial and extending in opposite directions and said bearing means includes two complementary bearing cups which are coaxial and facing each other, each of said bearing cups having an opening for receiving one of said pivots, each of said openings being slightly smaller than a diameter of said one of said pivots and being defined by resilient constrictions allowing said gas control to be mounted by radially pushing said pivots through said openings with resilient deflection of said constrictions and, after mounting, holding said pivots in said bearing cups.

8. Device according to claim 1, wherein said at least one pivot includes two coaxial bores and said bearing means includes two complementary bearing pins which are coaxial and extending toward each other, said bearing pins being attached to resilient walls allowing said gas control to be mounted by radially pushing said bores onto said bearing pins with resilient deflection of said resilient walls and, after mounting, holding said bearing pins in said bores.

* * * * *

UNITED STATES PATENT AND TRADEMARK OFFICE

CERTIFICATE OF CORRECTION

PATENT NO. : 6,178,941 B1
DATED : January 30, 2001
INVENTOR(S) : Mattinsson

It is certified that error appears in the above-identified patent and that said Letters Patent is hereby corrected as shown below:

Column 1,
Line 29, after "invention", insert -- wherein --.
Line 59, before "(FIGS. 2-3)", insert -- 14 --.

Column 2,
Line 7, delete "delete 11b, 12b", and insert — 11b, 11c, 12b, 12c --.

Signed and Sealed this

Twenty-fifth Day of September, 2001

*Attest:*

Nicholas P. Godici

NICHOLAS P. GODICI
*Acting Director of the United States Patent and Trademark Office*

*Attesting Officer*